US012064044B2

(12) United States Patent
Garcy

(10) Patent No.: US 12,064,044 B2
(45) Date of Patent: Aug. 20, 2024

(54) NAPKIN RING WITH INTERCHANGEABLE DECORATIVE TOPPER AND BASE

(71) Applicant: Gabrielle Garcy, Danville, CA (US)

(72) Inventor: Gabrielle Garcy, Danville, CA (US)

(73) Assignee: Geri Gabi, LLC, McKinney, TX (US)

( * ) Notice: Subject to any disclaimer, the term of this patent is extended or adjusted under 35 U.S.C. 154(b) by 67 days.

(21) Appl. No.: 18/111,855

(22) Filed: Feb. 20, 2023

(65) Prior Publication Data

US 2023/0263323 A1 Aug. 24, 2023

Related U.S. Application Data

(63) Continuation-in-part of application No. 17/383,364, filed on Jul. 22, 2021, now Pat. No. 11,583,121.

(60) Provisional application No. 63/055,440, filed on Jul. 23, 2020.

(51) Int. Cl.
*A47G 21/16* (2006.01)

(52) U.S. Cl.
CPC ..... *A47G 21/16* (2013.01); *A47G 2200/10* (2013.01)

(58) Field of Classification Search
CPC ..... A47G 21/16; A47G 2200/00; A47G 2200/106; A47G 2200/10; Y10T 24/1312; Y10T 24/32
See application file for complete search history.

(56) References Cited

U.S. PATENT DOCUMENTS

| | | | | |
|---|---|---|---|---|
| 3,965,591 | A | 6/1976 | Le Sueur | |
| 5,895,018 | A | 4/1999 | Rielo | |
| 6,536,235 | B2 | 3/2003 | Lovegrove | |
| 6,694,779 | B1 | 2/2004 | Dreger | |
| 6,836,899 | B1 * | 1/2005 | Glasmire | A45F 5/04 24/9 |
| 7,290,363 | B2 | 11/2007 | Turnwald | |
| 9,155,412 | B2 | 10/2015 | Yoham | |
| 9,392,848 | B2 * | 7/2016 | LeBlanc | A44C 1/00 |
| 2007/0050951 | A1 | 3/2007 | Simmons | |
| 2010/0269306 | A1 | 10/2010 | Read | |
| 2012/0328827 | A1 | 12/2012 | Vagliardo | |

* cited by examiner

*Primary Examiner* — Robert Sandy
(74) *Attorney, Agent, or Firm* — LOZA & LOZA LLP

(57) ABSTRACT

An embodiment of a napkin assembly is disclosed. The napkin assembly includes a napkin ring base including a base magnet, wherein a planar surface of the base magnet is raised with respect to a planar surface of the napkin ring base, and a ring topper including a topper magnet, wherein a planar surface of the topper magnet is flush with a planar surface of the ring topper, wherein the base magnet is magnetically connected to the topper magnet.

10 Claims, 14 Drawing Sheets

NAPKIN RING WITH INTERCHANGEABLE DECORATIVE TOPPER AND BASE

TECHNICAL FIELD

The present invention relates to a napkin ring that has various forms of interchangeability that can be used in a variety of decorative facets including with a free-standing napkin ring base or including a decorative topper affixed to the base ring for decoration and customization in design.

SUMMARY

A napkin ring assembly is disclosed. In an embodiment, a napkin assembly includes a napkin ring base including an embedded base magnet, wherein a planar surface of the base magnet is raised with respect to a planar surface of the napkin ring base, and a ring topper including a topper magnet, wherein a planar surface of the topper magnet is raised with respect to a planar surface of the ring topper, wherein the base magnet is magnetically connected to the topper magnet.

In an embodiment, the topper magnet is located at a center of gravity of the ring topper.

In an embodiment, the napkin ring base is rounded and includes a flattened surface to enable the rounded ring to stand upright.

In an embodiment, the base magnet of the napkin ring base is opposite the flattened surface.

In an embodiment, the napkin ring base has a square shape and wherein the base magnet is opposite one side of the square shape.

Another embodiment of a napkin assembly includes a napkin ring base including an embedded base magnet, wherein a planar surface of the embedded base magnet is raised with respect to a planar surface of the napkin ring base, and a ring topper including an embedded topper magnet, wherein a planar surface of the embedded topper magnet is raised with respect to a planar surface of the ring topper, wherein the embedded base magnet is magnetically connected to the embedded topper magnet.

In an embodiment, the embedded topper magnet is located at a center of gravity of the ring topper.

In an embodiment, the napkin ring base is rounded and includes a flattened surface to enable the rounded ring to stand upright.

In an embodiment, the embedded base magnet of the napkin ring base is opposite the flattened surface.

In an embodiment, the napkin ring base has a square shape and wherein the embedded base magnet is opposite one side of the square shape.

In an embodiment, another napkin ring assembly that has various forms of interchangeability that can be used in a variety of decorative facets including with a free-standing napkin ring base or including a decorative topper affixed to the base ring for decoration and customization in design is disclosed. An embodiment of a napkin assembly is disclosed. The napkin assembly includes a napkin ring base including an embedded base magnet, wherein a planar surface of the embedded base magnet is flush with a planar surface of the napkin ring base, and a ring topper including an embedded topper magnet, wherein a planar surface of the embedded topper magnet is flush with a planar surface of the ring topper, wherein the embedded base magnet is magnetically connected to the embedded topper magnet.

In an embodiment, the embedded topper magnet is located at a center of gravity of the ring topper.

In an embodiment, the napkin ring base is rounded and includes a flattened surface to enable the rounded ring to stand upright.

In an embodiment, the embedded base magnet of the napkin ring base is opposite the flattened surface.

In an embodiment, the napkin ring base has a square shape and wherein the embedded base magnet is opposite one side of the square shape.

BRIEF DESCRIPTION OF THE FIGURES

Various embodiments of the present invention now will be described more fully hereinafter with reference to the accompanying drawings. Not all embodiments of the invention will be depicted, but will show a broad overview which will satisfy applicable legal requirements. Throughout, the numbers refer to the figures depicted.

DETAILED DESCRIPTION

Figure 1:
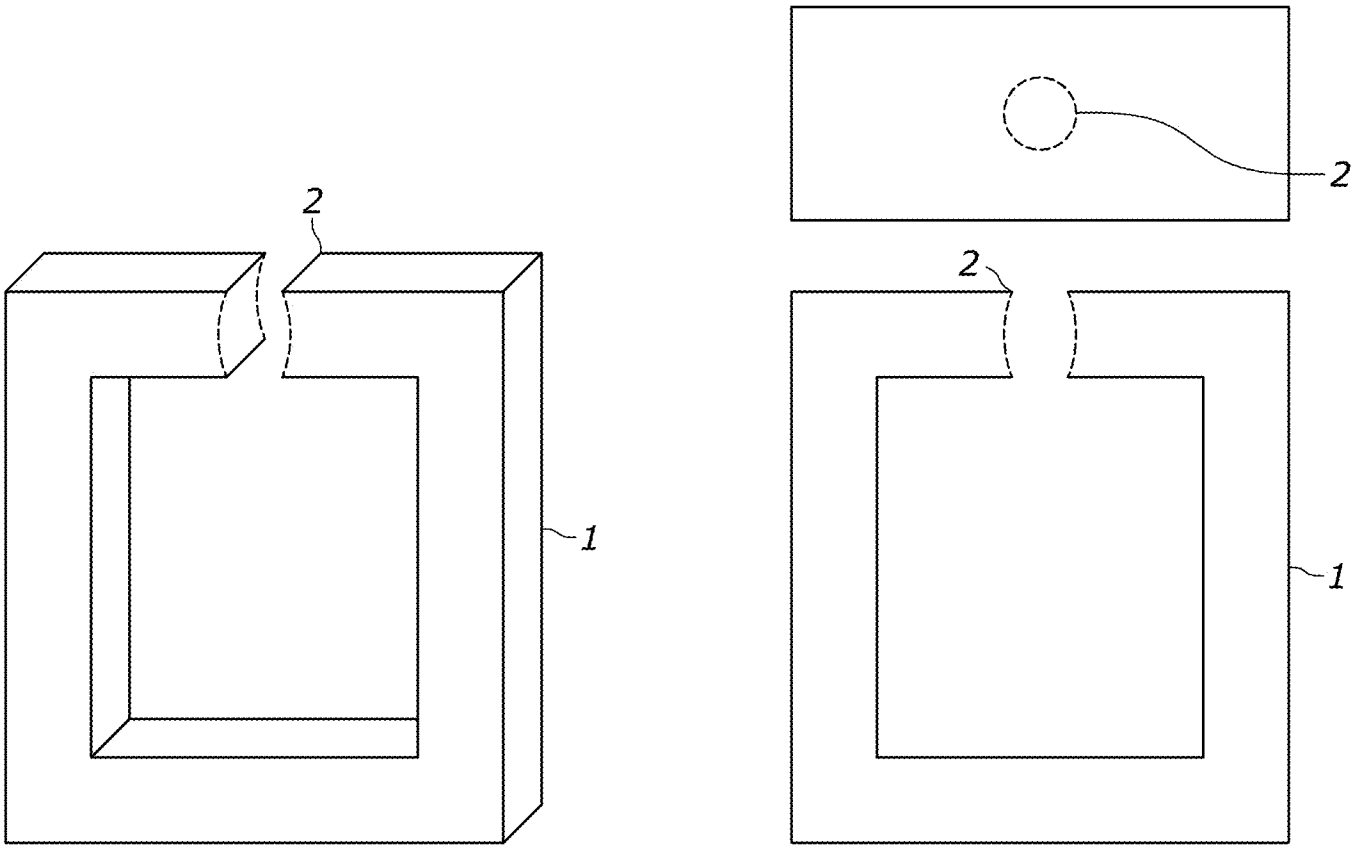
FIG. 1 is a straight on view of the napkin ring with a cone shape opening in the square base.
Figure 2:
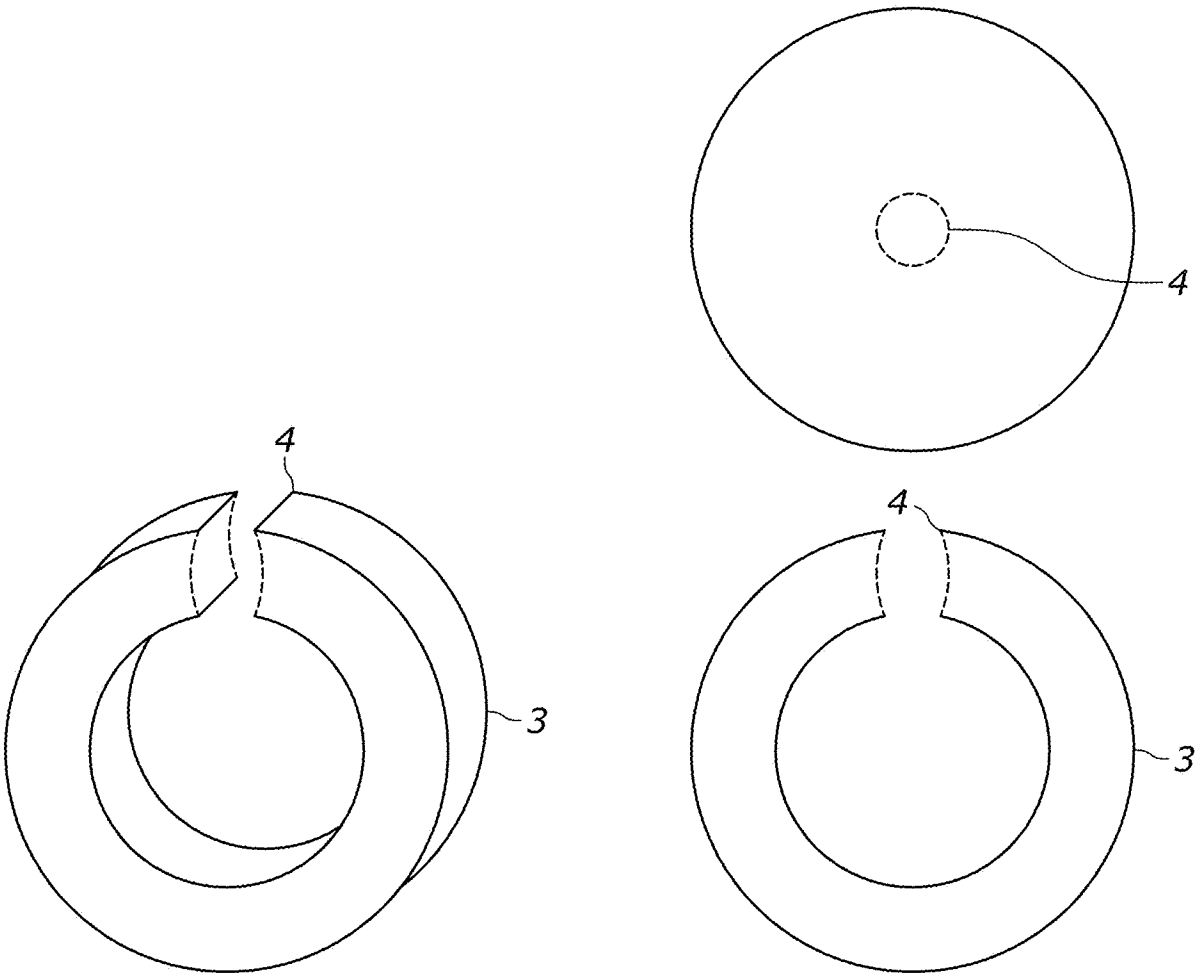
FIG. 2 is a straight on view of the napkin ring with a cone shape opening in the circular base.

Embodiments of the napkin ring bases are depicted in FIGS. 1 and 2, which illustrate the dimensional straight on view of a square napkin ring base 1 and circular napkin ring base 3 that will include, but not be limited to be manufactured with the following materials including metal, pewter, gold, silver, copper, paper, rattan, bamboo, capiz, plastic, acrylic, tortoise, and enamel. The square napkin ring base 1 and circular napkin ring base 3 each have an opening directed at the top of the rings which is a cone like opening depicted in 2 and 4. The opening runs the full depth of the napkin rings base. As shown in FIGS. 1 and 2, the napkin ring base can have a square shape or a round shape, and other shapes that allow a napkin to pass through are also possible.

Figure 3:
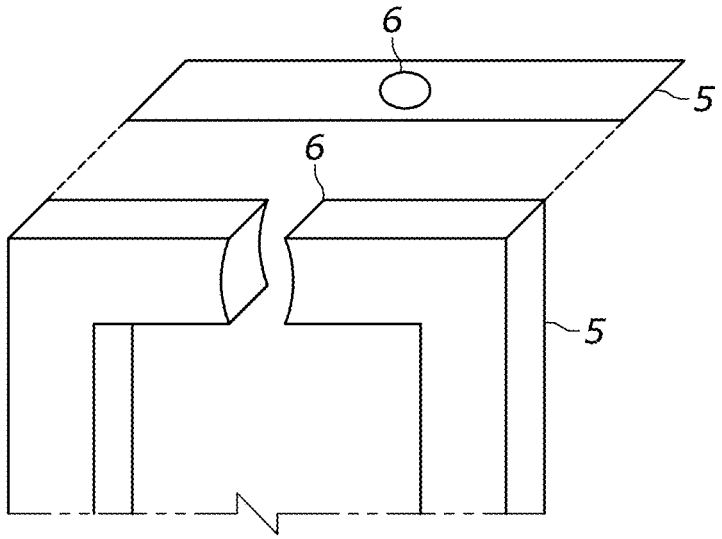
FIG. 3 is a top view of the square napkin ring base with the cone shape opening hole location for the post insert.
Figure 4:
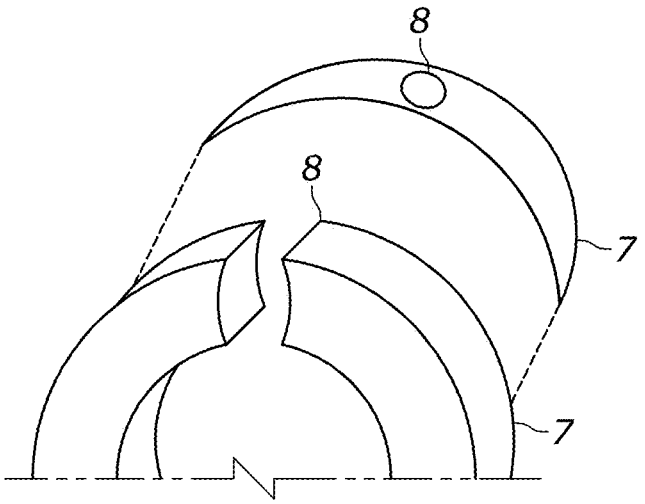
FIG. 4 is a top view of the circular napkin ring base with the cone shape opening hole location for the post insert.

Depicts a top view image of the square and circular napkin ring base in 5 and 7 where a cone shaped post on the base of the decorative topper inserts into the napkin ring cone base openings 6 and 8. The cone like openings depicted in 6 and 8 is where the interchangeable decorative topper with a connective post will be affixed in and out of the base napkin ring, which is shown at the top view of the napkin ring bases. FIG. 3-4 depict, but is not limited to any shape, material base including rubber, metal, plastic, resin or opening size in which the topper with a connective post will be affixed to the base.

Figure 5:
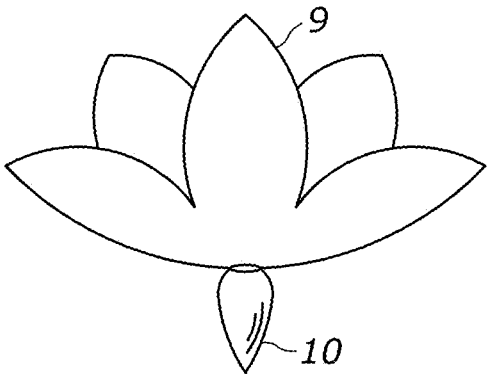
FIG. 5 is a direct view of the decorative topper with the post holder connected to the underneath of the base decorative topper.
Figure 6:
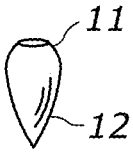
FIG. 6 is a straight on view of the post holder that attaches to the base of a decorative topper and inserts into the napkin ring base.

Depicted in FIG. 5 is an example of a decorative interchangeable napkin ring topper 9 with the connective post bottom 10. FIG. 5 includes the decorative topper with the connected post which is not limited to any decorative topper design and may include for example florals, seasonal decorations and a variety of exclusive designs. In the current description it is a flower, but is not limited to any designs that are signature to the brand made out of a variation of metals, pewter, gold, silver, copper, paper, rattan, bamboo, capiz, plastic, tortoise, enamel, and others. FIG. 6 is the bottom post holder which will be secured or adhered to the base of a decorative topper. The post holder will connect into the base napkin ring cone shape opening.

FIG. 6 is the post holder 10 that is connected to (e.g., glued, welded, etc) the base of the decorative topper 9 shown in FIG. 5. The top of the cone like post holder 10 is a flat oval like element 11 which is connected to the base of the decorative topper. The rubber, plastic, or metal cone shaped piece 12 is connected to the flat oval like element 11 of FIG. 6 which is a metal post 12 and covered with rubber, plastic, or resin material when inserted into the base napkin rings. Other materials may also be used to construct any aspect of FIG. 6.

Figure 7:
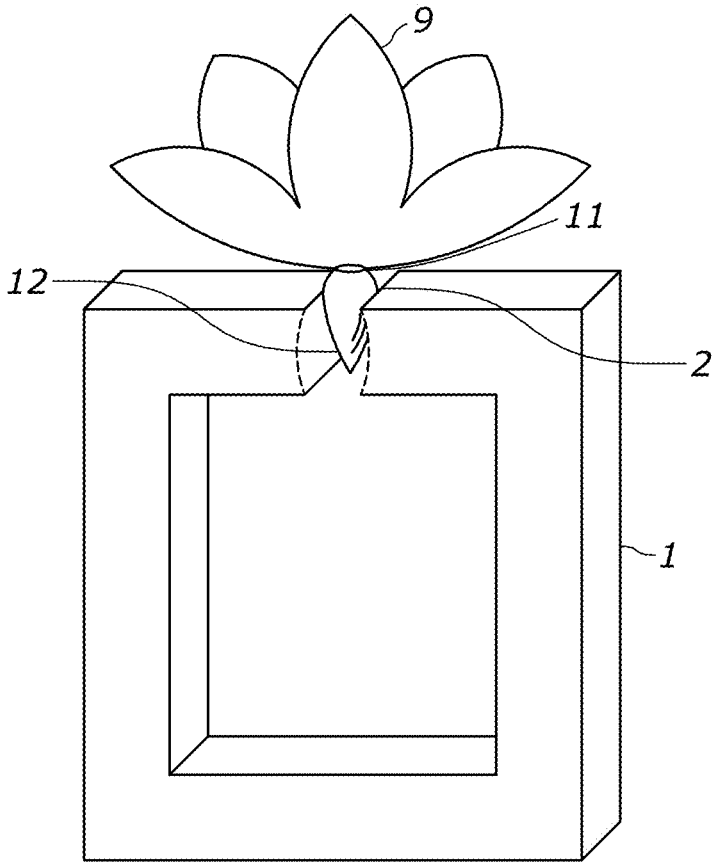
FIG. 7 is a straight on view of the interchangeable napkin ring assembled with the decorative topper post holder inserted into the cone shape opening of the square napkin ring base. Which depicts assembly of the various forms of interchangeability with the decorative topper and napkin ring base together.

FIG. 7 shows the straight on view of the interchangeable square napkin ring base 1 with the decorative topper 9 affixed to the top of the cone like post holder 12 by the flat oval like element 11 that is connected to a metal post 12 and covered with rubber, plastic, or resin when inserted through the opening 2 of the base napkin ring 1 connecting the decorative topper which is attached to the post holder as one unit as in shown in FIG. 5. to the square base napkin ring with a cone like opening in FIG. 1. Thus, combining FIG. 5. and FIG. 1. to show the full function and embodiments of FIG. 7. and therefore, the interchangeable designed invention, giving it the function to be used with a variety of colors, designs, shapes and materials.

Although a post holder and opening is described as an example of an attachment mechanism, other attachment mechanisms are possible.

Figure 8:
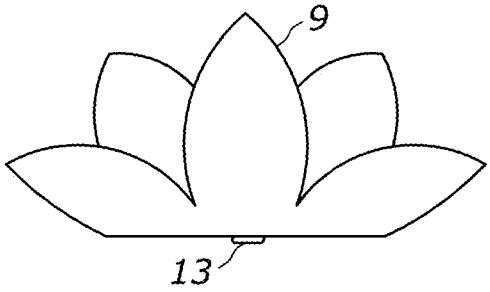
FIG. 8 is a direct view of the decorative topper with the magnet connected to the underneath of the base decorative topper.
Figure 9:
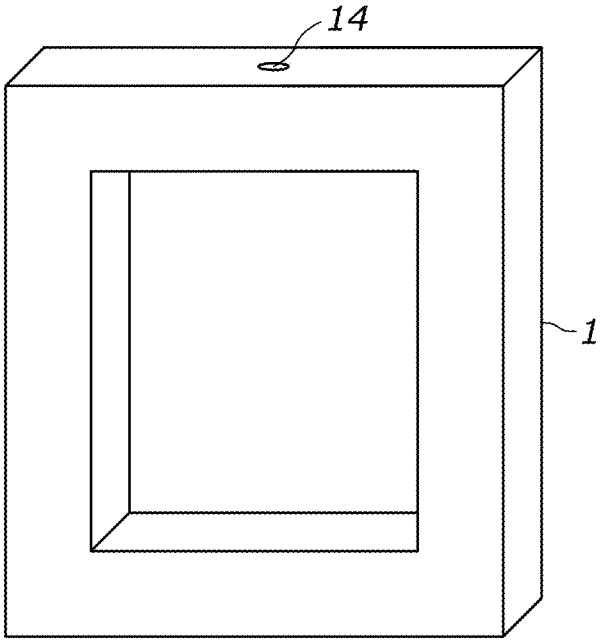
FIG. 9 is a straight on view of the square napkin ring base with a magnet placed on top or inside of the top portion of the square napkin ring base.

FIG. 8 shows a direct view of the decorative topper 9 with magnet 13 connected to the underneath of the base decorative topper. FIG. 9 is a straight on view of the square napkin ring base 1 with a magnet 14 placed on top or inside the top portion of the square napkin ring base. In an embodiment, the magnet 13 has a planar surface that is flush with a planar surface of the topper and the magnet 14 has a planar surface that is flush with a planar surface of the napkin ring base 1.

Figure 10:
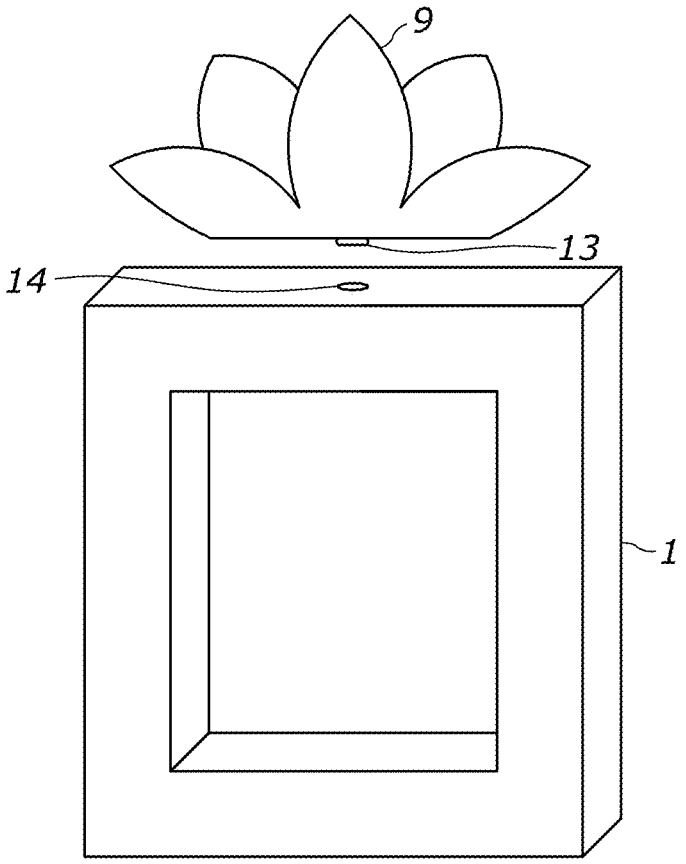
FIG. 10 is a straight on view of the interchangeable napkin ring, which is assembled with the magnet from the base of the decorative topper magnetized to the top of the square napkin ring base. The Figure depicts assembly of the full interchangeable function of the decorative topper and napkin ring base held together in a magnetic way.

FIG. 10 is a straight on view of the interchangeable napkin ring 1, which is assembled with the magnet 13 from the base of the decorative topper magnetized to the magnet 14 on the top of the square napkin ring base. FIG. 10 depicts assembly of the full interchangeable function of the decorative topper 9 with magnet 13 connected at the base of the decorative topper attached to the magnet 14 at the top of the square napkin ring base, thus holding the decorative topper 9 together to the square napkin ring base 1 in a magnetic function with the magnets 13 and 14. It has been found that using magnets on both the topper and the napkin ring base provides a strong enough attachment that the decorative napkin ring (base attached to the topper) can be lifted by the topper for movement without the topper coming apart from the base, while still allowing the topper to be removed with ease by a user.

Figure 11:
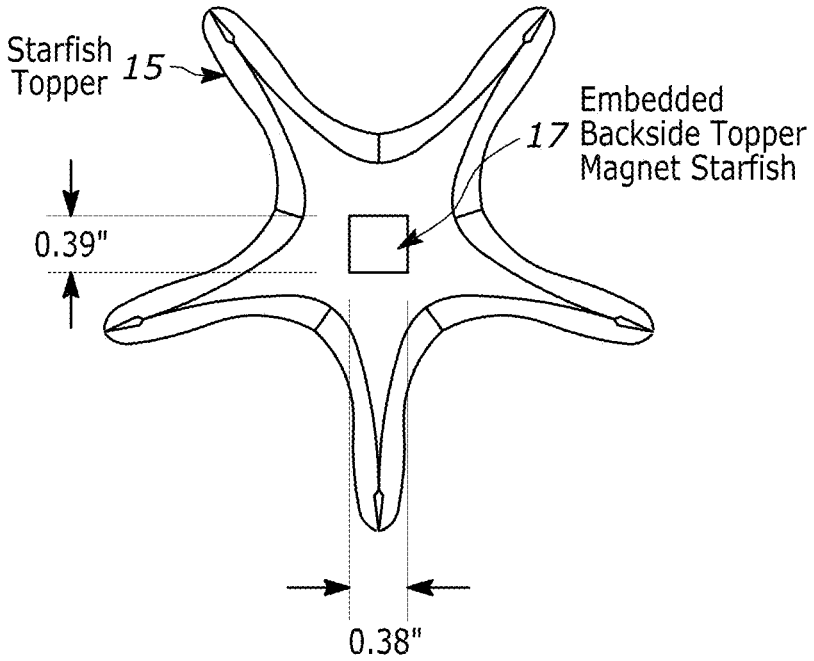
FIG. 11 is a straight on view of the backside of two decorative toppers with an embedded magnet that sits flush to the backside of the decorative toppers.
Figure 11:
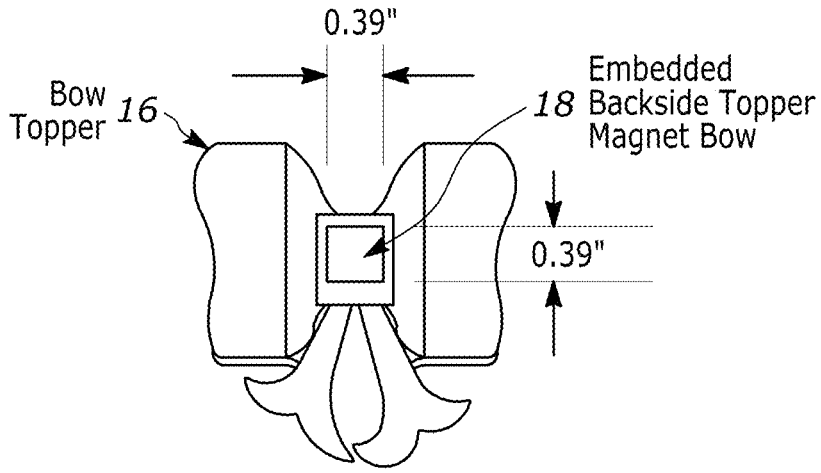

FIG. 11 shows a direct view of a decorative weighted interchangeable napkin ring Starfish Topper 15 with the engineered embedded backside topper magnet 17 centered (e.g., at the center of gravity of the topper) and sitting flush into the decorative topper back side. FIG. 11 also shows a direct view of a decorative weighted interchangeable napkin ring Bow Topper 16 with the engineered embedded backside topper magnet 18 centered (e.g., at the center of gravity of the topper) and sitting flush into the decorative topper back side. Through proper engineering and magnet placement the magnets evenly hold the distribution of the weight of the full decorative Topper piece that is embedded into the underneath (backside face) of the base decorative topper when connected on top of the napkin ring base through magnetization and proper distribution of weight when it sits on top of the base napkin ring and stabilizes as it stands alone as one unit.

Figure 12:
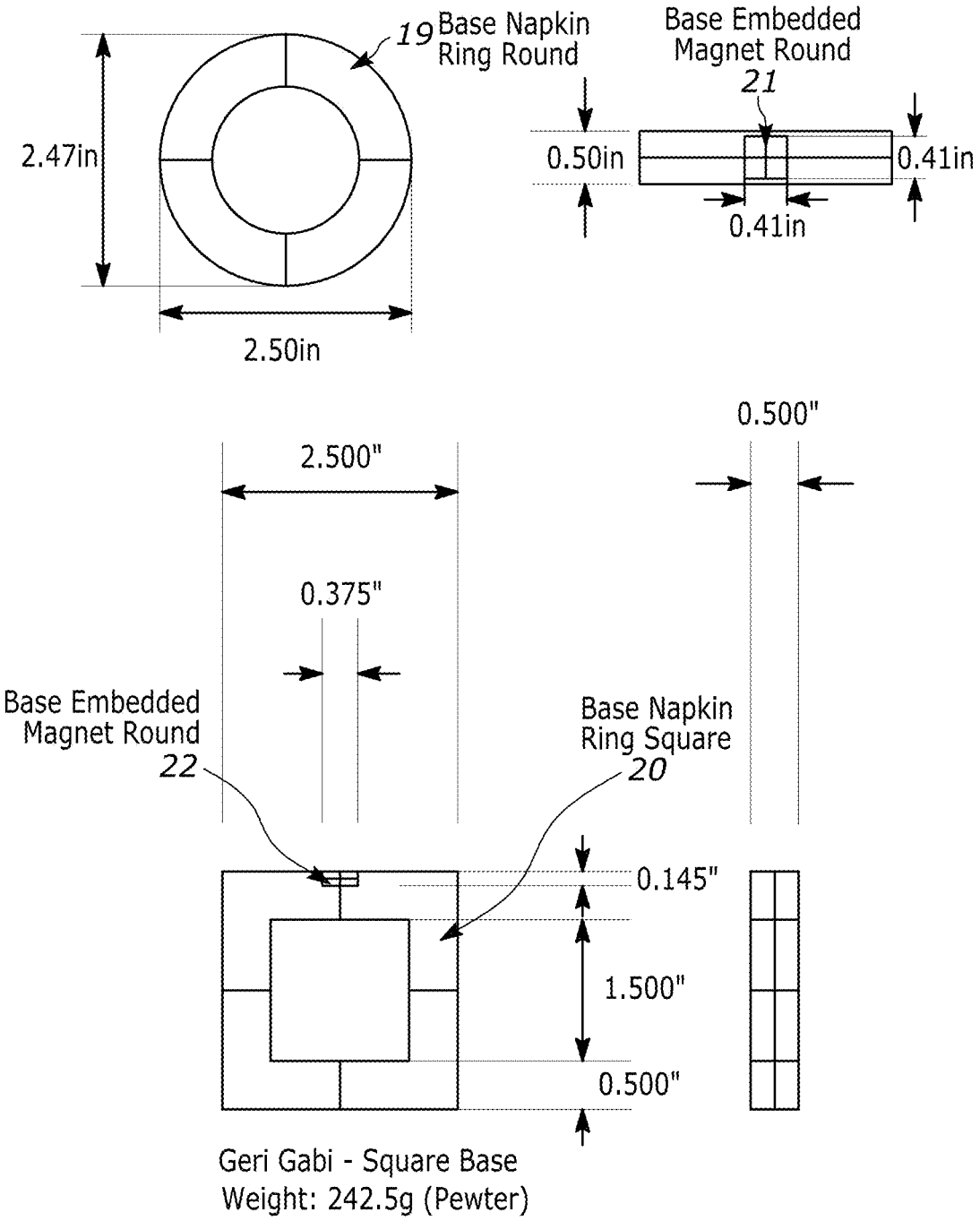
FIG. 12 is a straight on and top view of the round napkin ring base and the square napkin ring base with an embedded magnet that sits flush and centered to a top surface of the square and round napkin bases.

FIG. 12 is a straight on view of the Base Napkin Ring Square 20 and Base Napkin Ring Round 19 with a Base Embedded Magnet Round 21 and Base Embedded Magnet Square 22 inside the napkin ring base which is centered in the top of the base 19 and 20 and engineered to sit flush to the top of the napkin ring base. Thus, the magnet 21 and 22 is engineered to be centered into the base ring therefore properly distributing the weight of the topper when the two pieces are connected as one unit and sits balanced as it stands alone. Therefore, the Base Napkin Ring Round and Base Napkin Ring Square have the embedded magnets that is engineered into the bases to ensure the weight is evenly distributed as the base stands alone as one napkin ring piece stabilized in function and design or when it holds the distribution of the weight from the engineered decorative topper pieces and is balanced as a unit. The Base Napkin Ring Round 19 is specifically engineered with a flattened bottom to ensure the weight of the base standing alone is evenly distributed and can function as a single Napkin Ring Piece without any topper bonded to the magnet. The Base Embedded Magnet Round 21 is designed to sit flush to the top of the base ring therefore giving the Base Napkin Ring Round 19 the ability to stand alone and useful as its own napkin ring holder. The Base Napkin Ring Square 20 is engineered so that when the Base Embedded Magnet Square 22 sits flush to the top of the napkin ring and when turned around to the bottom of the ring the Base Napkin Ring Square free stands with or without a napkin and is useful as its own napkin ring piece. Therefore, the bases, both round and square when standing on their own and the Base Embedded Magnets Round 21 or Square 22 sit flush to the topside of the base napkin ring can be used as a single decorative unit with or without a napkin when freestanding. The magnet is designed in the napkin ring bases to sit flush to a hard surface thus, allowing the napkin ring base to stand alone as its own design piece without or with an attached decorative topper giving consumers multi-use through the engineering of the bases to have a Base Napkin Ring Round 19 or Square 20 to stand alone as Napkin Ring or customize a full unit with decorative topper, which through the magnets are bonded together and through weight distribution/magnet placement can balance while freestanding as a decorative napkin ring unit.

Figure 13:
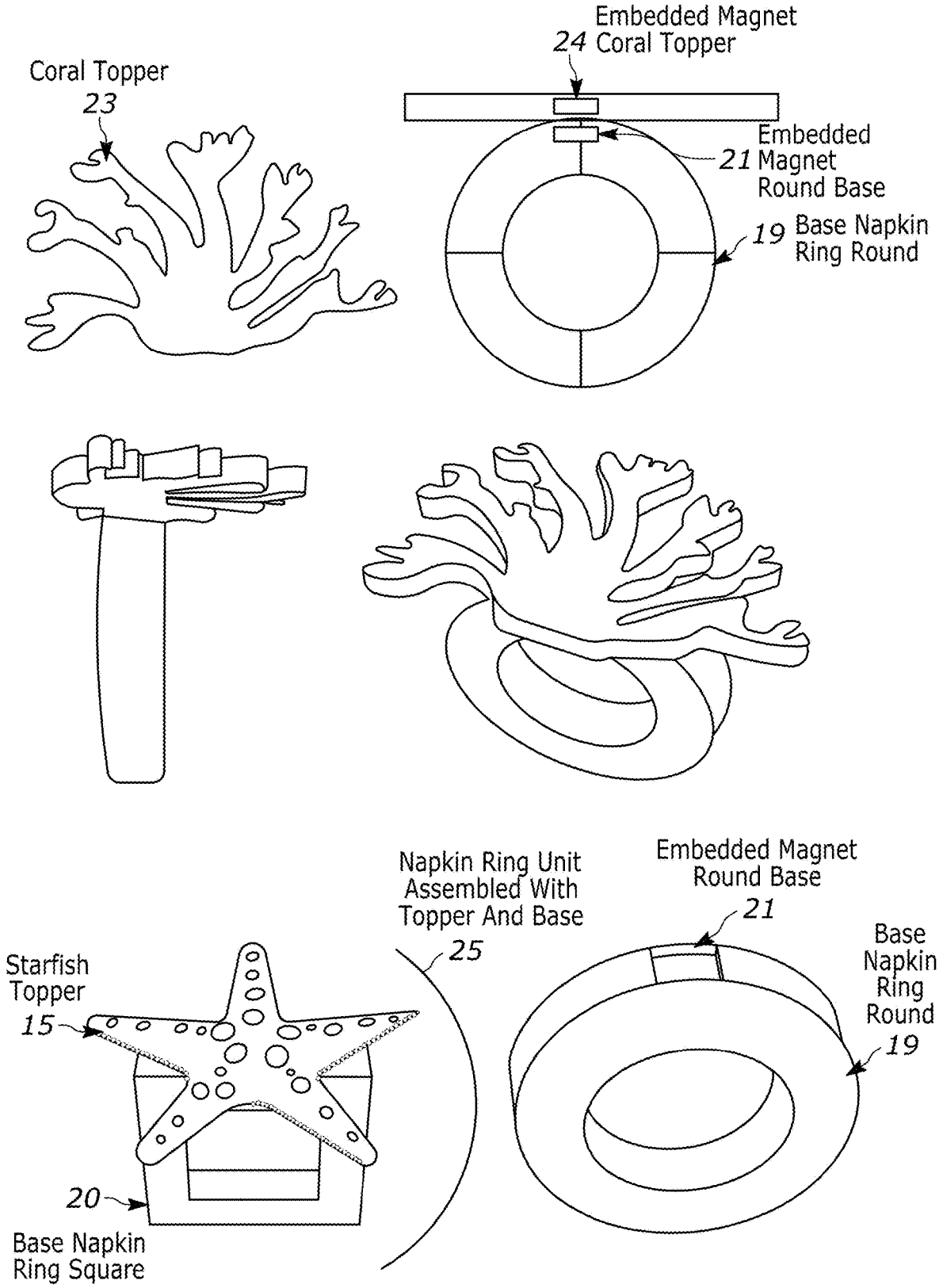
FIG. 13 includes top, side, and perspective views of a napkin ring unit assembled with topper and base magnetized together.

FIG. 13 includes top, side, and perspective views of interchangeable Base Napkin Ring Round 19, which is assembled together as one unit with the Embedded Magnet for Round Base 21, which is specifically placed and is evenly distributed in weight to the Embedded Magnet Coral Topper 24 from the weight of the Embedded Magnet Coral Topper 24 on the backside face of the decorative topper magnetized (connected or securely bonded together) to the Embedded Magnet Round Base 21 that sits embedded and centered into the round napkin ring base that properly distributes the weight and is bonded together as the magnets adhere when the topper is magnetically attached to the base magnet Embedded Magnet for Round Base 21. Both the Embedded Magnet for Coral Topper 24 and base centered magnet 21 are engineered and designed with evenly distributed weight of both the pieces, thus giving the pieces the flexibility to stand alone or together through a bonded magnet and even distribution of weight and proper placement of the magnet function. These pieces can be used as stand alone decorative objects or as one decorative multi-use napkin ring. FIG. 13 depicts assembly and magnetization of the full interchangeable function of the decorative Coral Topper 23 with evenly distributed weight of the centered Embedded Magnet for Coral Topper 24 connected and bonded through magnetization and distribution weight symbiotically working together at the base face of the decorative topper attached to Embedded Magnet for Round Base 21 at the center of the embedded top of the Base Napkin Ring Round 19 or square 20, thus connecting the decorative Coral Topper 23 or Starfish Topper 15 together to the round Napkin Ring base 19 or Square napkin ring base 20 magnetically bonded with engineered weight distribution function with the embedded and engineered placement of the centered Embedded Magnet for Coral Topper 24 and Embedded Magnet for Round Base 21 in relation to the specifically designed decorative Coral Topper 23 and Starfish Topper 15 and round napkin ring base 19 and Square napkin ring base 20 pieces, therefore through the engineered magnet placement to balance distribution of weight through the pieces that interchange and bond together they are designed to host flexibility for consumers to adjust and customize the specific placement of the topper unit piece 15 and 23 in relation to where it will sit and magnetize to the Base Napkin Ring Round 19 and Square 20 that keeps the Coral Topper 23 stabilized for all function of design possibilities and movement for aesthetic and usage purposes. The magnetized bonding of the decorative topper and base napkin ring is to assure the unit does not come apart when being moved around a table unless force is used to separate the base napkin ring from the decorative topper. Because of the engineered distribution of weight and magnet placement the manipulation of desired decorative topper placement can be arranged for the consumers needs and does not have to be limited on the base napkin ring in one specific attachment as the napkin ring unit sits balanced and stabilized when freestanding as well as a Napkin Ring Unit Assembled with Topper and Base 25.

The embodiments on the invention is not considered as a limitation on the scope of the invention. In any aspects and embodiments of the inventions from specification on dimensions and materials. The variations are not limited to any combination, styles and materials. It is important to note that drawings are not direct to scale, but are depicting the overall function of the invention. Materials listed are not limited to the wide variety of materials that can be used to support the making of the invention. The sizes and shapes of the invention can be altered at any time to support the success of combining both the topper and base.

An object of the present napkin ring is to attach an interchangeable decorative topper object to the base napkin ring. This gives the object the interchangeable flexibility to create mixing and matching decorative styles and color tones that complements table décor depending on season, color scheme etc. The topper may have attached through welding, glue, a latch or slide mechanism, velcro, etc., a metal cone like post, covered in a rubber like material at the base of the decorative topper which will insert into the adjacent cone shape opening at the top of the napkin ring base. The topper may also have a magnet embedded, glued, welded etc., to the base of the decorative topper and an additional magnet attached to the base napkin ring that sits embedded inside and flesh to the metal or on top of the pieces. Therefore, when put together the decorative topper and base napkin ring will magnetize together. Thus, the function of the object is being able to interchange decorative toppers with a variety of shapes and materials into a variation of napkin ring bases through distribution of weight and engineered design. The invention allows for the base napkin rings to have multi-use through the magnet placement and sitting flesh to the surface stabilizes the napkin ring base to be used as a single unit with or without a napkin ring and able to freestand without a napkin. This allows for a multi-range of uses whether the napkin ring base round or square is used to style on its own. The napkin ring unit when a topper and base is connected through the bonded magnet allowing for a wide range of napkin ring décor styles for the table place settings including a range of styles which the decorative topper sits and adjusts to the base napkin ring. Consumers can move the topper around on the base napkin ring and the unit stays stabilized to customize the napkin ring unit and remaining standing up without a napkin placed through the base ring because of the distribution of weight, therefore the unit can be freestanding through weight of the combined unit and engineering of the distribution of that weight on the base napkin ring and decorative topper.

The decorative toppers are not limited to multi-use including being used on not only interchangeable napkin ring bases, but decorative chargers, plates etc. Here where the embedded magnet would sit flush to the plate that can be in a variety of materials such as acrylic, metal, plastic, resin, etc. and the topper with the magnet that sits flush to the backside of the decorative topper will bond together in magnetization for an interchangeable and multi-use charger plate.

Another embodiment of the napkin ring assembly is disclosed. In an embodiment, the napkin ring assembly utilizes a raised magnet at the planar surface of the napkin ring base.

Figure 14:
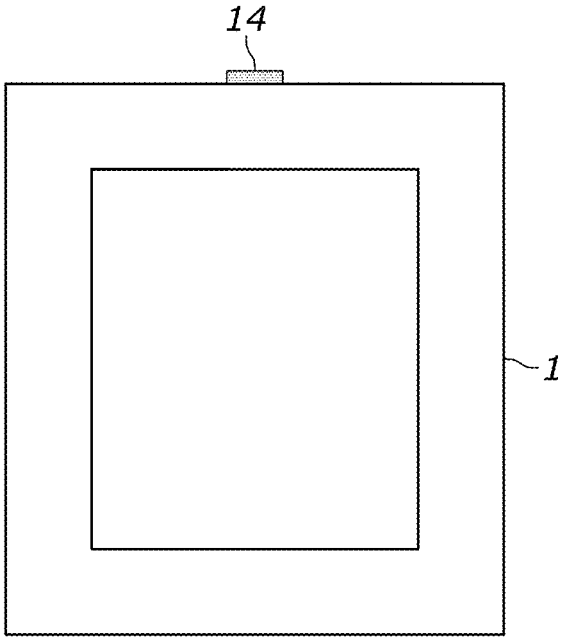
FIG. 14 is a side view of the square napkin ring base with a magnet embedded into the base napkin ring and rises above the planar surface of the top flat portion of the base napkin ring.

FIG. 14 is a side view of the square napkin ring base 1 with a magnet 14 embedded into the base napkin ring. In the embodiment of FIG. 14, the magnet 14 rises above the planar surface of the top flat portion of the square napkin ring base 1. In an example embodiment, the magnet 14 rises above the planar surface of the square napkin ring base 1 by about 2 mm (±20%). Although not shown in FIG. 14, the magnet is embedded into a cavity of the napkin ring base 1. For example, the magnet may be embedded by a couple of millimeters, e.g., 2 mm±20% into a cavity that has the same shape as the magnet but is slightly larger than the footprint of the magnet to allow the magnet to sit down in the cavity. In an embodiment, the magnet 14 has a planar surface upon which a decorative topper will sit. Additionally, although not shown, the raised magnet concept is applicable to napkin ring bases that have shapes other than a square. For example, the magnet 14 may be raised above a planar surface of a ring shaped napkin ring base such as the ring shaped napkin ring base shown in FIGS. 12 and 13. For example, in the embodiments to FIGS. 12 and 13, the ring shaped napkin ring base has two opposing planar surfaces, one planar surface that enables the base to sit still on a flat surface and another planar surface at which the magnet is embedded and at which a topper is received. In an embodiment, the magnet 14 has an exposed planar surface that is centered to evenly balance the napkin ring base 1 if the base is placed on a flat surface magnet-side down, therefore protecting the napkin ring base by elevating the base from the underlaying surface when the base stands alone on the surface. That is, the planar surface of the magnet 14 can serve to magnetically secure a topper (such as topper 9) and to be an elevated balance point for the napkin ring base 1 when the napkin ring base is used without a topper and positioned with the magnet 14 on a flat surface (e.g., a table) to both hide the magnet from view and elevate the planar surface of the base above the flat surface (e.g., slightly above the table surface).

Figure 15:
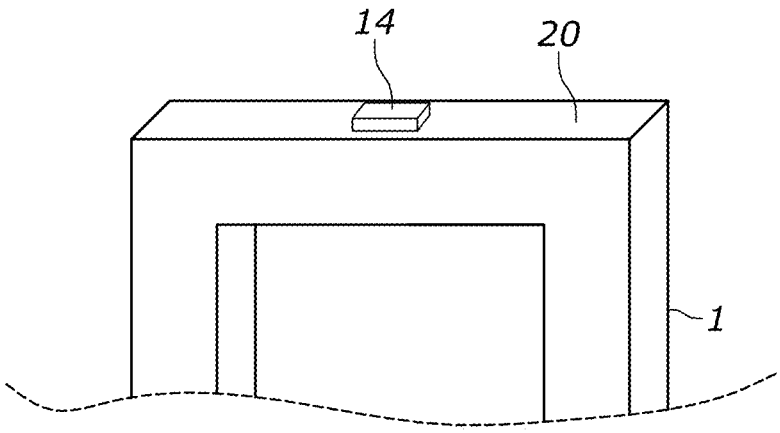
FIG. 15 is a perspective view of a portion of the square base napkin ring base from FIG. 14 that shows the magnet raised above the top planar surface of the base.

FIG. 15 is a perspective view of a portion of the square base napkin ring base 1 from FIG. 14 that shows the magnet 14 raised above the planar surface 20 of the napkin ring base 1. For example, the magnet 14 has a planar surface that is raised about 2 mm (±20%) above the planar surface 20 of the napkin ring base 1. Although not shown if FIG. 15, the magnet 14 may also be embedded below the planar surface 20 of the napkin ring base 1 as described with reference to FIG. 14. In other embodiments, the planar surface 20 does not include a cavity in which the magnet can be embedded and the magnet may be attached (e.g., glued) directly to the planar surface 20.

Figure 16A:
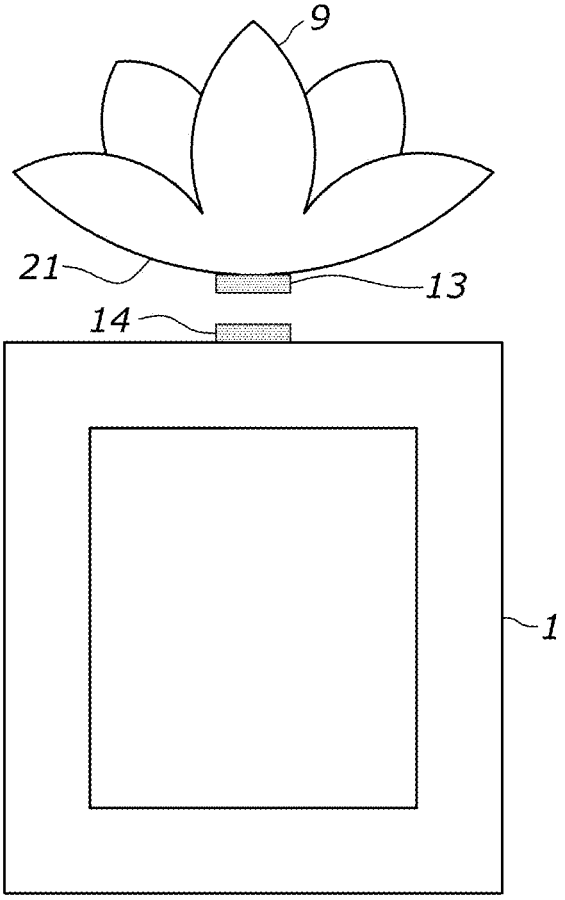
FIG. 16*a* is a side view of a napkin ring assembly that includes the square napkin ring base and the topper in which the magnet of the topper is not yet touching the magnet of the napkin ring base.

FIG. 16*a* is a side view of a napkin ring assembly that includes the square napkin ring base 1 and the topper 9. In the example of FIG. 16*a*, the magnet 13 of the topper 9 is raised relative to a bottom planar surface 21 of the topper and is not yet touching the magnet 14 of the napkin ring base 1. However, as the two magnets are brought close enough to each other, magnetic forces will cause the magnet 13 of the topper 9 and the magnet 14 of the napkin ring base 1 to magnetically engage each other with enough force to hold the two pieces together unless or until they are separated by, for example, the force of a hand pulling on the topper while holding the base.

Figure 16B:
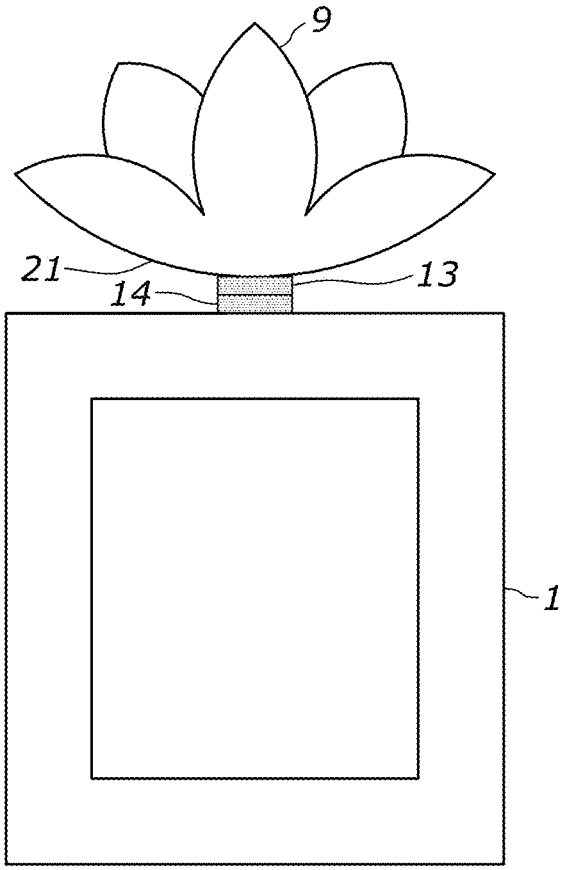
FIG. 16*b* is a side view of the square napkin ring base and the topper of FIG. 16*a* after the magnet of the topper and the magnet of the napkin ring base are magnetically engaged with each other.

FIG. 16*b* is a side view of the square napkin ring base 1 and the topper 9 after the magnet 13 of the topper 9 and the magnet 14 of the napkin ring base 1 are magnetically engaged with each other. As shown in FIG. 16*b*, because the magnet 14 of the napkin ring base 1 is raised above the planar surface of the napkin ring base, the topper 9 and the napkin ring base 1 do not touch each other while the two pieces are magnetically connected to each other. It has been found that when the magnet 14 is raised above the planar surface 20 of the napkin ring base, the napkin ring base 1 and the topper 9 tend to be less susceptible to damage such as chipping, denting, scratching, color transfer, and/or color rub-off that may occur when the two pieces contact each other, especially when the two piece contact each other when the two pieces are being connected together and/or when the two pieces are being separated from each other.

As shown in FIG. 16*b*, the magnet 14 of the napkin ring base 1 and the magnet 13 of the topper 9 are both raised above their respective planar surfaces. While have the topper magnet 13 or the base magnet 14 raised above their respective surface can provides benefits against damage, it has also been found that having both magnets raised above their respective planar surfaces can further enhance the protection against damage. FIGS. 16*a* and 16*b* depict an embodiment in which the magnet 14 is raised above the planar surface 20 of the napkin ring base and magnet 13 is raised above the bottom planar surface 21 of the topper 9. This configuration tends to be less susceptible to damage such as chipping, denting, scratching, color transfer, and/or color rub-off that may occur when the two pieces contact each other, especially when the two piece contact each other when the two pieces are being connected together and/or when the two pieces are being separated from each other.

In FIGS. 14-16*b*, the embodiment shown includes a raised magnet 14 above the planar surface 20 of the napkin ring base 1. In an embodiment, the magnet 14 is raised approximately 2 mm above the planar surface 20 and is shown in the design to benefit both the napkin ring base 1 and decorative topper 9 when used together as one unit and when the magnets are magnetized together. In an embodiment, the raised magnet 14 on the napkin ring base 1 creates extra separation from the topper 9 that protects the topper 9 and the napkin ring base 1 from damage when the two pieces are connected. The raised magnets on the napkin ring topper 13 and raised magnet 14 at the napkin ring base when used together or alone can help to protect the napkin ring base and/or the topper from chipping, denting, scratching, color transfer, and/or color rub-off. The raised magnet 14 on the napkin ring base 1 evenly balances its weight on the magnet 14 therefore protecting the surface area of the napkin ring base 1 on all materials in which the base napkin ring can be made up of. The raised magnet 14 on the napkin ring base 1 can add benefits and protection to the napkin ring base from a perspective of design, style, usability, protection and longevity of the piece.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

What is claimed is:

1. A napkin assembly comprising:

a napkin ring base including an embedded base magnet, wherein a planar surface of the base magnet is raised with respect to a planar surface of the napkin ring base; and a ring topper including a topper magnet, wherein a planar surface of the topper magnet is raised with respect to a planar surface of the ring topper;

wherein the base magnet is magnetically connected to the topper magnet.

2. The napkin assembly of claim 1, wherein the topper magnet is located at a center of gravity of the ring topper.

3. The napkin assembly of claim 1, wherein the napkin ring base is rounded and includes a flattened surface to enable the rounded ring to stand upright.

4. The napkin assembly of claim 3, wherein the base magnet of the napkin ring base is opposite the flattened surface.

5. The napkin assembly of claim 1, wherein the napkin ring base has a square shape and wherein the base magnet is opposite one side of the square shape.

6. A napkin assembly comprising:

a napkin ring base including an embedded base magnet, wherein a planar surface of the embedded base magnet is raised with respect to a planar surface of the napkin ring base; and a ring topper including an embedded topper magnet, wherein a planar surface of the embedded topper magnet is raised with respect to a planar surface of the ring topper;

wherein the embedded base magnet is magnetically connected to the embedded topper magnet.

7. The napkin assembly of claim 6, wherein the embedded topper magnet is located at a center of gravity of the ring topper.

8. The napkin assembly of claim 6, wherein the napkin ring base is rounded and includes a flattened surface to enable the rounded ring to stand upright.

9. The napkin assembly of claim 8, wherein the embedded base magnet of the napkin ring base is opposite the flattened surface.

10. The napkin assembly of claim 6, wherein the napkin ring base has a square shape and wherein the embedded base magnet is opposite one side of the square shape.

* * * * *